US005220952A

United States Patent [19]

Beaulieu

[11] Patent Number: 5,220,952

[45] Date of Patent: Jun. 22, 1993

[54] FLEXIBLY INTERCONNECTED PANELS

[75] Inventor: Bryan Beaulieu, Burnsville, Minn.

[73] Assignee: Skyline Displays, Inc., Burnsville, Minn.

[21] Appl. No.: 938,403

[22] Filed: Aug. 31, 1992

[51] Int. Cl.[5] ..... A47G 5/00

[52] U.S. Cl. ..... 160/231.1; 160/135

[58] Field of Search ..... 160/229.1, 231.1, 231.2, 160/135; 52/239; 40/605, 610

[56] References Cited

U.S. PATENT DOCUMENTS

| | | | |
|---|---|---|---|
| 1,888,030 | 11/1932 | Ely | 160/229.1 X |
| 3,889,736 | 6/1975 | Firks . | |
| 4,134,439 | 1/1979 | Scott | 160/135 |
| 4,436,135 | 3/1984 | Ytter . | |
| 4,722,146 | 2/1988 | Kemeny . | |
| 4,830,080 | 5/1989 | Densen . | |
| 5,092,385 | 3/1992 | Beaulieu . | |
| 5,143,137 | 9/1992 | West | 160/229.1 X |

*Primary Examiner*—David M. Purol

*Attorney, Agent, or Firm*—Palmatier, Sjoquist & Helget

[57] ABSTRACT

A fastening device for resiliently attaching adjacent panel sections together in edgewise alignment, wherein the panel sections respectively have pairs of alignable openings through peripheral edge extrusions, and the fastening device includes a pair of guide members for inserting into the openings of a first panel section and slidable locking devices for inserting into the edge extensions of a second panel section, and an elastic cord having ends secured by the locking devices and a length fed through the alignable openings and guide members.

14 Claims, 2 Drawing Sheets

FLEXIBLY INTERCONNECTED PANELS

BACKGROUND OF THE INVENTION

The present invention relates to exhibit display devices, and more particularly to exhibit display devices formed of a plurality of integrated panels.

In the portable exhibit display field it is important that devices utilized for display purposes have a pleasing appearance, while at the same time being constructed of lightweight materials which may be readily transported. It is also important that exhibit displays of this type be capable of disassembly or contraction into a relatively small package, so that the package may be easily transported from place to place. Portable exhibit displays which can be easily expanded into an erected state having a large surface area are advantageous, for the enlarged surface area provides a display surface for graphics and other visual display materials. In the erected position, the exhibit display should present a pleasing continuous appearance and should be capable of freestanding without external supports.

Portable exhibit displays of the type described herein are typically transported in travel cases, and it is a particular advantage of the portable exhibit display to be broken down into sufficiently small modules or packages so as to be amenable to transport in a travel case which can be easily handled by a single person. This requirement dictates that the panel structure be made from lightweight materials, but the materials must be sufficiently durable so as to withstand repeated usage. U.S. Pat. No. 5,092,385, issued Mar. 3, 1992, discloses one such panel exhibit display system, wherein individual panel sections may be interlocked against adjacent panel sections, or may be hingedly connected to adjacent panel sections.

SUMMARY OF THE INVENTION

The present invention is an apparatus for use in conjunction with a plurality of thin rectangular panels having extruded edge constructions. The apparatus includes a resilient cord having enlarged stops affixed to each end, at least two guideways for insertion into openings through the panel edge extrusions, and at least two slidable latches for engagement in the panel edge extrusions and for locking and releasing the cords into the panels. The apparatus permits two adjacent panel sections to be fastened together, either hingedly or in planar alignment; the apparatus may be repeatedly used in a plurality of panel sections to create an overall portable exhibit display surface which is formed of a plurality of sections aligned in various configurations relative to each other. The apparatus further permits a plurality of panel sections to be hingedly folded together for storage and transport.

A principal object and feature of the present invention is an edgewise panel fastening device which permits either edgewise alignment of panel sections or hinged connection of panel sections.

Another object and advantage of the present invention is a flexible hinge member which may be releasably engaged to a panel section.

Another feature and advantage of the present invention is a flexible hinge and attachment member which permits panel sections to be configured into a plurality of shapes and sizes, and permits disassembly of a portable exhibit display panel.

The foregoing and other objects and advantages of the invention will become apparent from the following specification and claims, and with reference to the appended drawings.

DESCRIPTION OF THE PREFERRED EMBODIMENT

Figure 1A:
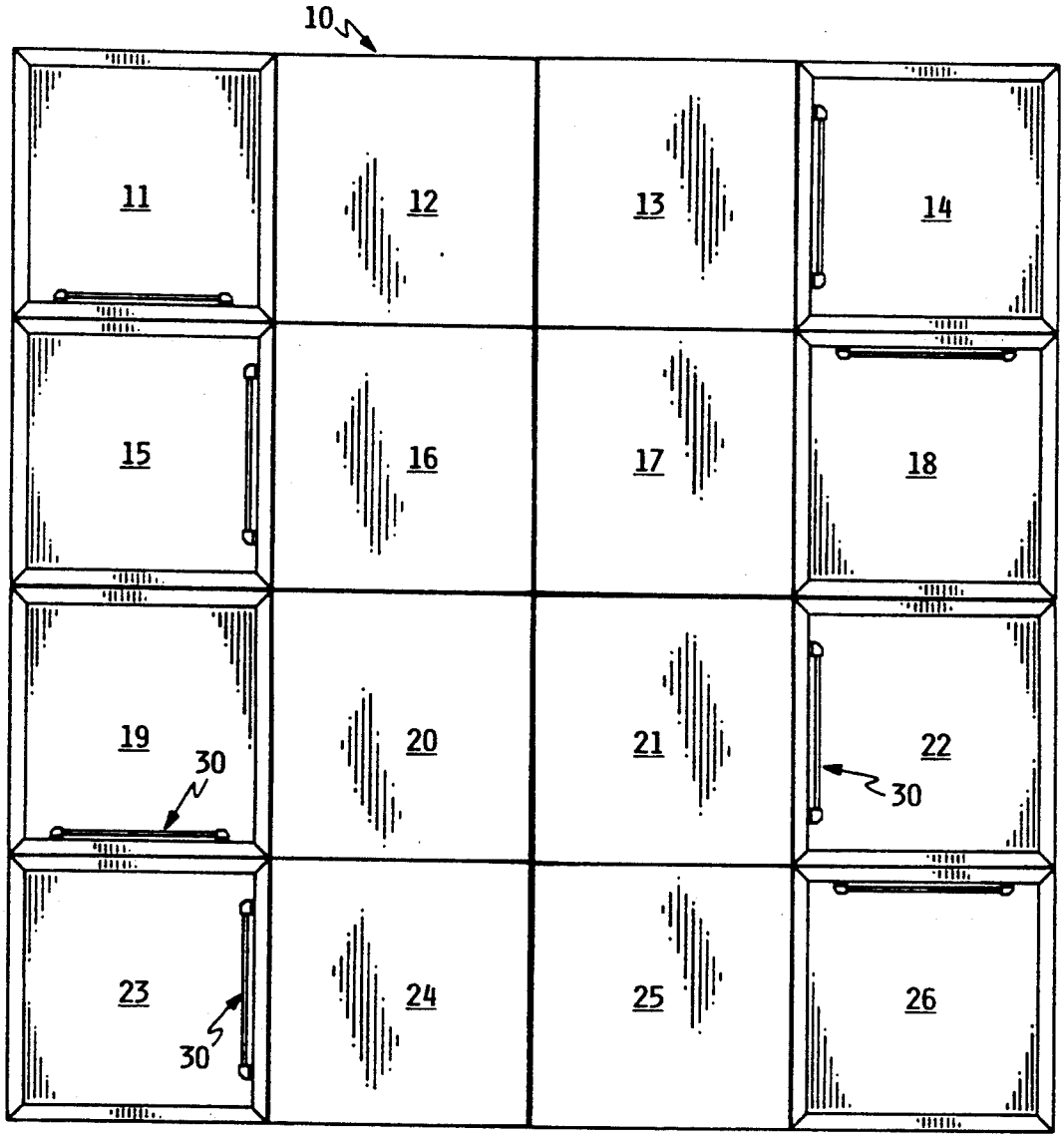
FIG. 1A shows an erected portable exhibit display system according to the present invention.

Referring first to FIG. 1A, one form of the invention is shown in an erected condition. A portable exhibit display panel 10 is formed of a plurality of panel sections 11–26. In the form shown, portable exhibit display panel 10 is an enlarged planar surface wherein each of the panel sections 11, 12 . . . 26 are respectively edge aligned to maintain an overall flat surface. It should be noted that the panel system 10 could also be hingedly deformed along any of the horizontal or vertical intersecting lines between the respective sections.

Figure 1B:
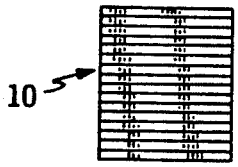
FIG. 1B shows the system of FIG. 1A in one folded configuration.

FIG. 1A also shows several different panel configurations by way of illustration. Each panel section comprises a rectangular section having a peripheral frame and a covering material over either or both of the flat surfaces defined by the peripheral frame. Panel sections 12, 13, 16, 17, 20, 21, 24, 25, are all shown with a covering material over the panel frames, in the facing direction. The remaining panel sections show a covering material over the rearwardly facing panel surfaces, thereby leaving the panel frames exposed in the facing direction. Covering materials may be made from plastic or cloth material, or any other material which may be reasonably applied to the extruded frame peripheral edges. Either or both panel surfaces may be covered, with the same or different materials, to provide for a wide variety of aesthetic appearances. Each panel section is hingedly attached to an adjacent panel section by a fastening device 30, which is placed along an inside edge of a peripheral frame section. FIG. 1B shows one form of folded panel system 10, wherein all of the panel sections have been hingedly aligned adjacent one or more further panel sections, to form an elongated stack of panel sections. In practical application the stack of FIG. 1B would be broken into a plurality of smaller stacks, by disconnecting the fastening devices 30 between certain adjacent panel sections. It has been found that a stack of approximately four panel sections is best suited for storage in a transport case, and for transporting from place to place.

Figure 1C:
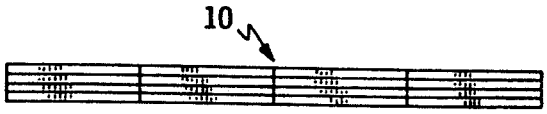
FIG. 1C shows the system of FIG. 1A in another folded configuration.
Figure 5:
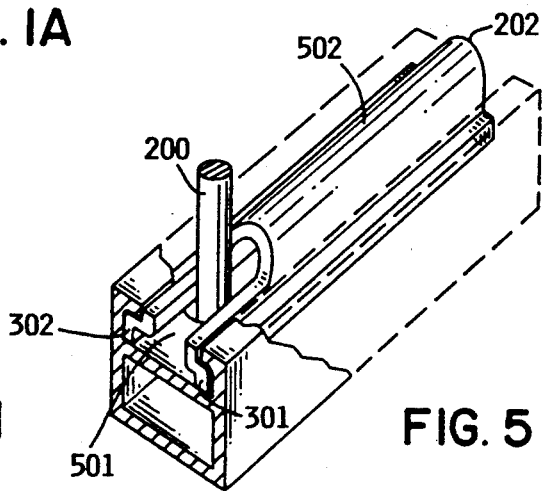
FIG. 5 shows the locking slide of the present invention.

FIG. 1C shows another form of folding panel system 10, wherein the panel sections have been respectively folded along three lines. In this form, an elongated stack of four panel sections is created, which could be handled for storage. However, it is preferable to detach certain panel sections from engagement with the overall system in order to create smaller packages for storage and carrying.

Figure 2:
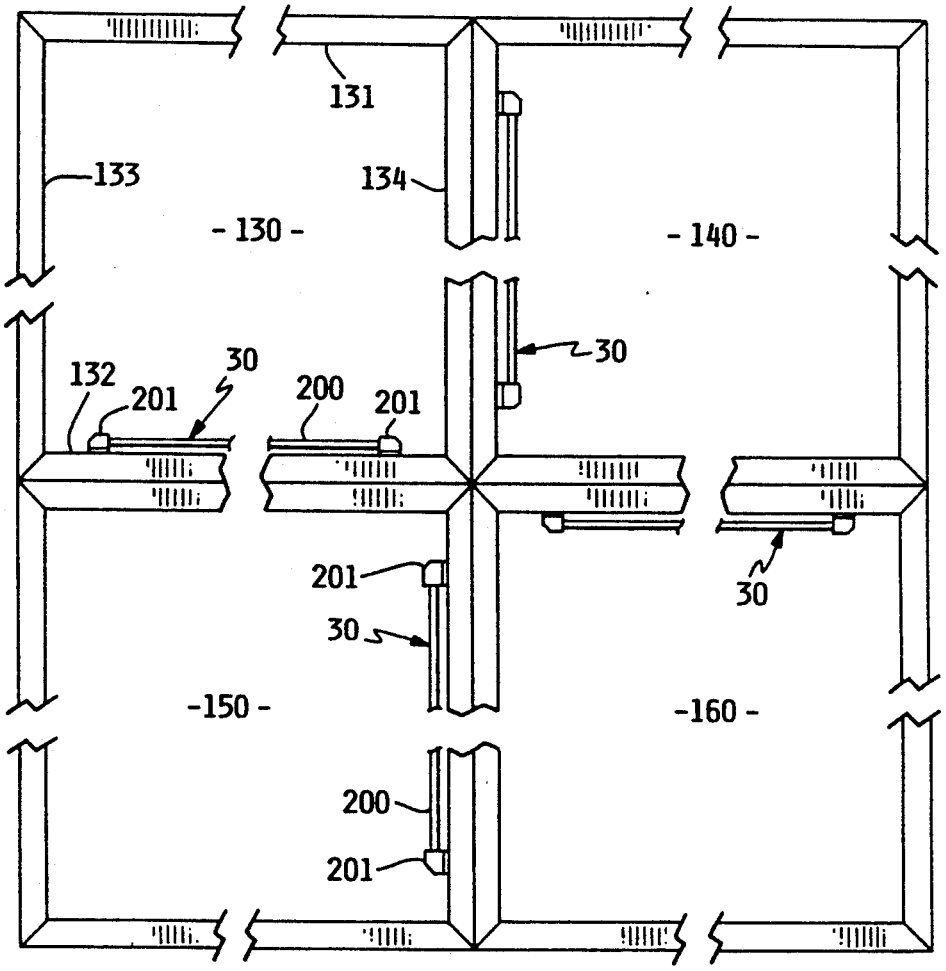
FIG. 2 shows portions of a panel system utilizing the present invention.

FIG. 2 shows the invention interconnecting four panel sections, wherein the surface covering material of each of the panel sections has been removed. Each panel section is formed of an outer peripheral frame, the frame preferably being made from extruded aluminum or plastic, having a predefined arrangement of elongated channels as will be hereinafter described. The extrusions which form the panel edges are all of identical cross-section construction, and are respectively sized to form any desired rectangular or square configuration. For example, panel section 130 has an upper edge extrusion 131 and a lower edge extrusion 132, of equal length. It also has left and right edge extrusions 133, 134 of equal length. Corner joints are formed and the respective adjacent extrusion corners are bonded together to form a relatively strong frame; therefore the frame about section 130 is comprised of the rigid edge extrusion members 131, 134, 132, and 133. Other panel sections have similar frame edges, and the respective frame edges may be closely aligned along their external edges to neighboring frames.

Frame section 130 is connected to frame section 150 by means of fastening device 30; frame section 130 is connected to frame section 140 by means of another fastening device 30; frame section 140 is connected to frame section 160 by means of another fastening device 30; and frame section 150 is connected to frame section 160 by means of yet another fastening device 30. All of the fastening devices 30 are identical in construction, and will therefore be described hereinafter as a single device.

Figure 3:
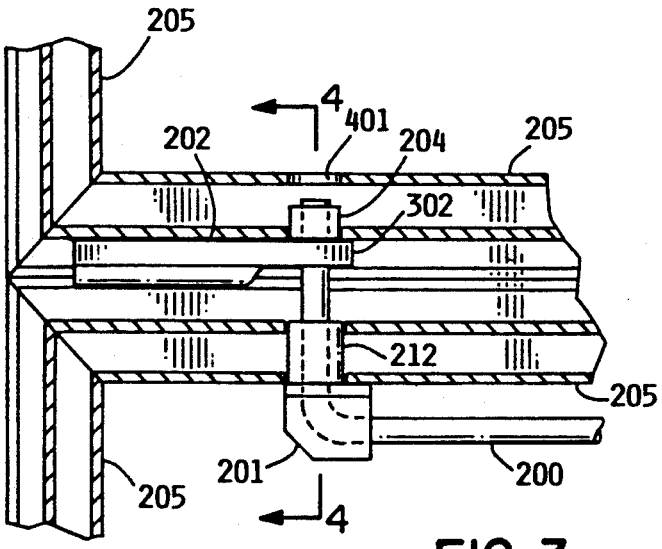
FIG. 3 shows an enlarged cross-section view of the present invention engaged into a panel system.
Figure 4:
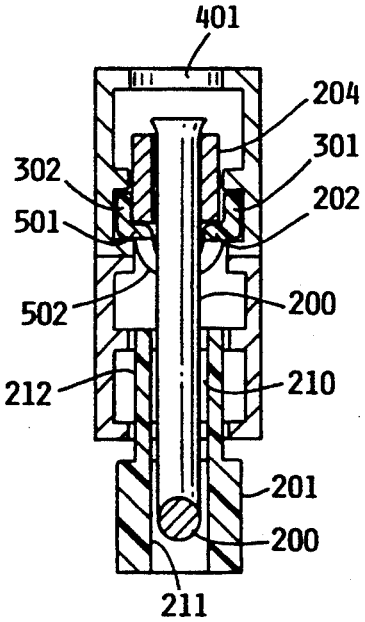
FIG. 4 shows a cross-section view taken along the lines 4—4 of FIG. 3.

Referring to FIGS. 2–4, a fastening device includes an elastic cord 200, a pair of guide members 201, and a pair of locking slides 202. The ends of each of the elastic cords are fitted with a stop 204 which is clamped to the elastic cord. All of the frame sections have identical extruded edge members 205, which are respectively cut to length with a 45° end angle for purposes of abutting against an adjacent extrusion. The corners of the respective extruded sections forming one frame perimeter are fixedly attached as by welding or soldering, to form a rigid rectangular frame. All of the edge extrusions have a predrilled hole through the extrusion at a distance relatively close to a corner section. The holes are all arranged so that they are alignable when any two edge sections are placed in side-by-side relationship. One of these holes is shown in FIG. 3 as hole 401.

The invention is formed by first threading the respective ends of the elastic cord 200 through guide members 201, and then clamping locking member 204 to the respective ends of the elastic cord 200. Guide member 201 has a central opening 210 for receiving elastic cord 200, and a curved channel 211 for guiding elastic cord 200 about a right angle. Guide member 201 has a shank 212 which is sized for interference fitting into a hole 401, so that when guide member 201 is pressed into hole 401 the shank 212 rigidly affixes the guide member in place.

With guide member 201 affixed in position in an extrusion 205, the elastic cord may be pulled outwardly from guide member 201 and may be threaded through a corresponding hole 401 in an adjacent frame section. When the stop 204 has been pulled sufficiently far into the adjacent extrusion the locking slide 202 may be slidably positioned along the extrusion so as to capture the cord between two legs 301 and 302. Legs 301 and 302 are sufficiently far apart to accept the elastic cord 200, but are sufficiently close together so as to block the passage of stop 204. Locking slide 202 thereby prevents the elastic cord stop 204 from moving toward guide member 201, and holds the elastic cord 200 in a relatively stretched position. A similar set of connections is made with respect to the other end of cord 200, with a result that cord 200 is held in a stretched position with its respective stop members 204 clamped into an adjacent extrusion, whereas the guide members 201 are positioned in a first extrusion.

Locking slide 202 is slidable within the extrusion channel 501 formed in the edge section, and may therefore be withdrawn from engagement about cord 200. Locking slide 202 has a curved top portion 502 which projects into the extrusion of the adjacent edge section, thereby providing an indexing function to hold the respective edge sections in edgewise alignment. Therefore, the respective adjacent panel sections are held together in edgewise alignment by the elastic force created by cord 200. Respective adjacent panel sections may be hingedly moved about their edge joints, which movement is permitted by the stretching of cord 200 to permit the necessary separation between the edge members in order to achieve the hinging action.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for resiliently attaching adjacent panel sections together in edgewise alignment and also forming a hinge, comprising:

a) an elastic cord having a pair of enlarged ends, and means for releasably holding each of said enlarged ends in spaced apart relationship in a first panel section;

b) a pair of guide members adjacent the edge of a second panel section, said guide members being also in spaced apart relationship, and said elastic cord passing through said guide members;

c) said elastic cord therefore passing through edges of both said first panel section and said second panel section, whereby the edges of said first and second panel sections are resiliently held together in edgewise alignment.

2. The apparatus of claim 1, wherein said means for releasably holding each of said enlarged ends in a first panel section further comprises a locking member slidably positionable in said first panel section.

3. The apparatus of claim 2, wherein said locking member further comprises a pair of spaced-apart legs sized for engaging about said elastic cord but preventing said enlarged end from passing therebetween.

4. The apparatus of claim 3, wherein said guide members each further comprise a right angle slot for guiding said elastic cord about a 90° angle.

5. The apparatus of claim 4, wherein said guide members each further comprise a passage sized larger than said elastic cord and aligned adjacent said right angle slot.

6. The apparatus of claim 5, wherein said first and second panel sections each further comprise extruded edge members, said edge members having an elongated interior channel running along an outer edge.

7. The apparatus of claim 6, wherein said locking member is slidably positionable in said channel.

8. The apparatus of claim 7, wherein said edge members further comprise a pair of spaced-apart holes drilled into said channels, said holes sized to accept said enlarged ends therethrough.

9. A fastening device for resiliently attaching adjacent panel sections in edgewise hinged alignment, wherein said panel sections include peripheral extruded edge members having spaced apart openings therethrough, comprising:

a) a pair of locking members adapted for slidably fitting into a first panel section extruded edge member;

b) a pair of guide members adapted for insertion into the spaced apart openings of a second panel section extruded edge member; and c) an elastic cord sized for fitting through the spaced apart openings of said edge members, having respective enlarged ends which may be held by said locking members and said elastic cord being threadable through said guide members.

10. The apparatus of claim 9, wherein each of said locking members further comprise a pair of spaced apart legs, said legs being spaced apart a distance wider than said cord but narrower than said enlarged ends.

11. The apparatus of claim 10, wherein each of said locking members further comprise a raised section bridging said spaced apart legs, said raised section extending outside said extruded edge member when said locking member is slidably fitted into said extruded edge member.

12. The apparatus of claim 11, wherein said guide members each further comprise a shank sized for interference fitting into said extruded edge member openings.

13. The apparatus of claim 12, wherein said guide members each further comprise a right angle channel sized larger than the width of said cord.

14. The apparatus of claim 13, wherein said right angle channel further comprises a hole through said shank and a curved channel in 90° alignment with said hole.

* * * * *